US005339741A

United States Patent [19]

Craven et al.

[11] Patent Number: 5,339,741

[45] Date of Patent: Aug. 23, 1994

[54] PRECISION FIREWORKS DISPLAY SYSTEM HAVING A DECREASED ENVIRONMENTAL IMPACT

[75] Inventors: B. Thomas Craven, Windermere; William G. Wiedefeld; Kyle W. Poor, both of Clermont, all of Fla.; Bruce S. Johnson, North Hollywood, Calif.; John W. Sogge, Orlando, Fla.; Michael H. Peterson, Glendale, Calif.; William G. Adamson, Pacoima, Calif.; Ronald W. Froelich, Covina, Calif.

[73] Assignee: The Walt Disney Company, Burbank, Calif.

[21] Appl. No.: 817,591

[22] Filed: Jan. 7, 1992

[51] Int. Cl.[5] ..... F42B 4/04

[52] U.S. Cl. ..... 102/361; 102/431; 102/206; 102/493

[58] Field of Search ..... 102/328–330, 102/361, 206, 431, 493

[56] References Cited

U.S. PATENT DOCUMENTS

| | | | |
|---|---|---|---|
| 356,651 | 1/1887 | Linton | 102/324 X |
| 421,310 | 2/1890 | Reynolds | 102/324 X |
| 1,550,670 | 8/1925 | Bfrandt | 102/324 X |
| 1,762,044 | 6/1930 | Bedient | 102/331 X |
| 1,922,081 | 8/1933 | Driggs | 102/21 |
| 2,006,271 | 6/1935 | Hitt | 102/20 |
| 2,053,772 | 9/1936 | Fabrizio | 102/25 |
| 2,086,618 | 7/1937 | Hitt | 102/23 |
| 2,087,281 | 7/1937 | Fabrizio | 102/23 |
| 2,311,721 | 2/1943 | Wilson | 102/24 |
| 2,809,624 | 10/1957 | Becher et al. | 124/11 |
| 3,025,633 | 3/1962 | Kaye et al. | 124/73 X |
| 3,032,970 | 5/1962 | Fox | 60/35.3 |
| 3,068,756 | 12/1962 | Schermuly | 89/1.5 |
| 3,102,477 | 9/1963 | Stefan et al. | 102/37.6 |
| 3,385,163 | 5/1968 | Kotikov | 89/1 |
| 3,481,246 | 12/1969 | Snyder | 89/1.5 |
| 3,500,746 | 3/1970 | Ambrosini | 102/70.2 |
| 3,535,809 | 10/1970 | Hoffmann | 42/1 |

(List continued on next page.)

FOREIGN PATENT DOCUMENTS

| | | |
|---|---|---|
| 2424900 | 12/1974 | Fed. Rep. of Germany . |
| 3812644 | 3/1988 | Fed. Rep. of Germany . |
| 2659429 | 9/1991 | France . |
| 0049900 | 5/1981 | Japan . |
| 1410798 | 10/1975 | United Kingdom . |
| 2195420 | 4/1988 | United Kingdom . |

OTHER PUBLICATIONS

Drawing re "Oriental Shell 'Warimono' Class* Single--Break" giving detailed description thereof, one page.

Drawing describing in depth "Canister Shell Repeating Color/Effect" one page.

Drawing describing in depth"'Roman' Candle"; 'Gerbe' (Fountain); and 'Mine Bag', one page.

Cover page of Scientific American magazine No. C.2, one page showing Fireworks, Article entitled "Pyrotechnics" by John A. Conkling, Scientific American magazine Jul. 1990, pp. 96–102.

*Primary Examiner*—Peter A. Nelson

*Attorney, Agent, or Firm*—Pretty, Schroeder, Brueggemann & Clark

[57] ABSTRACT

A system and method for launching projectiles, such as fireworks projectiles, which explode in the air into a pyrotechnic display. The projectile includes a shell constructed from a binding agent and an explosive additive which explodes the shell into small particles. The explosive additive, which may be nitrocellulose, causes the exploded particles to be rapidly burned and consumed to form lightweight, inert flakes that fall harmlessly to the ground. The projectile is aimed and launched by a launcher using a compressed gas to rapidly expel the projectile from a launching tube. Once in the air at a predetermined location in the sky, an electronic fuse inside the projectile operates to detonate the projectile into its intended pyrotechnic display. The fuse is extremely accurate and enables detonation of the projectile at precise altitudes. An electronic control system controls launching and detonation of the projectiles in a precise and repeatable manner.

46 Claims, 13 Drawing Sheets

U.S. PATENT DOCUMENTS

| | | | |
|---|---|---|---|
| 3,665,862 | 5/1972 | Lane | 102/103 |
| 3,670,649 | 6/1972 | Hartlein et al. | 102/38 X |
| 3,698,317 | 10/1972 | Finch | 102/37.4 |
| 3,726,266 | 4/1973 | Palmer | 124/59 |
| 3,739,726 | 6/1973 | Pintell | 102/70.2 |
| 3,747,532 | 7/1973 | Berger | 102/97 |
| 3,827,360 | 8/1974 | Geimer | 102/70 F |
| 3,901,153 | 8/1975 | Brabets et al. | 102/43 R |
| 3,927,616 | 12/1975 | Axelrod et al. | 102/38 |
| 3,964,395 | 6/1976 | Kaiser et al. | 102/70.2 R |
| 3,977,325 | 8/1976 | Jacobsen et al. | 102/43 R |
| 3,987,731 | 10/1976 | Brzuskiewicz | 102/43 R |
| 4,069,761 | 1/1978 | Jimenez | 102/37.4 |
| 4,116,133 | 9/1978 | Beuchat | 102/215 |
| 4,233,673 | 11/1980 | Cricchi et al. | 102/276 X |
| 4,419,933 | 12/1983 | Kirby et al. | 102/206 |
| 4,421,030 | 12/1983 | DeKoker | 102/206 X |
| 4,424,745 | 1/1984 | Magorian et al. | 102/206 X |
| 4,445,435 | 5/1984 | Oswald | 102/206 X |
| 4,586,437 | 5/1986 | Miki et al. | 102/206 X |
| 4,644,864 | 2/1987 | Komorowski et al. | 102/206 X |
| 4,664,035 | 5/1987 | Osofsky | 102/493 |
| 4,697,518 | 10/1987 | Lau et al. | 102/358 |
| 4,705,655 | 11/1987 | Maures et al. | 264/3.4 |
| 4,712,477 | 12/1987 | Aikou et al. | 102/206 |
| 4,771,695 | 9/1988 | Simpson | 102/343 |
| 4,825,765 | 5/1989 | Ochi et al. | 102/206 |
| 4,829,899 | 5/1989 | Wiker et al. | 102/206 |
| 4,917,015 | 4/1990 | Lowery | 102/342 |
| 4,930,393 | 6/1990 | Castro, Jr. | 102/206 X |
| 5,157,225 | 10/1992 | Adams et al. | 102/493 |
| 5,187,323 | 2/1993 | Saxby | 124/73 X |

PRECISION FIREWORKS DISPLAY SYSTEM HAVING A DECREASED ENVIRONMENTAL IMPACT

BACKGROUND OF THE INVENTION

The present invention relates to fireworks displays and, more particularly, to a new method and system of presenting precision fireworks displays with a decreased environmental impact.

"Pyrotechnics" is the "science of fire." Pyrotechnic displays, commonly referred to as fireworks or fireworks displays, have been created and enjoyed for centuries by millions of people. Over the years, the systems and methods for creating the displays have remained substantially unchanged.

The fireworks systems of the prior art are comprised essentially of two main components, namely a pyrotechnic projectile and a mortar for directing the pyrotechnic projectile into the air. The pyrotechnic projectile itself consists of two principal components, comprising an initial burst and a main burst. Black powder is one of the oldest pyrotechnic propulsion agents and it is typically used as the initial burst and main burst component. The main burst also includes pellets of color composition known as "stars." Igniting the stars during detonation of the main burst provides the light and color of the fireworks display.

Common pyrotechnic projectiles comprise an inner shell and an outer shell. To preserve the main burst until aerial ignition, the main burst is enclosed within the inner shell, while the initial burst is enclosed within the outer shell. The pyrotechnic projectile also has two fuses in the form of an initial fuse and a main fuse. The main fuse extends from the initial burst in the outer shell to the main burst in the inner shell. The initial fuse extends from the initial burst to the exterior of the outer shell. By igniting the initial fuse, the initial burst is exploded and propels the pyrotechnic projectile from the mortar into the air. Contemporaneously, the main fuse is lit because the end of the main fuse protrudes into the initial burst. The main fuse then takes a specific time to burn into and ignite the main burst.

The pyrotechnic projectile can take on various shapes. For cylindrical shells, the main burst includes stars which are randomly packed. Upon detonation of the main burst, the shell opens, and the stars are ignited in an irregular visual pattern. For round shells, the main burst consists of the stars arranged around a central core of black powder. When the main burst of the round shell is ignited, the stars are distributed in a round, symmetrical pattern. Sometimes the shell will contain a flash-and-sound powder, instead of stars, to produce a flash of light and a loud noise.

Factors in raising the pyrotechnic projectile to a particular altitude are aerodynamic drag, projectile stability and the size of the initial burst. In this regard, pyrotechnic projectiles are usually hand manufactured, and various materials have been used to form the pyrotechnic projectile's outer shell, including paper and plastics. The manufacturing variations, therefore, can cause uncertainties in the final shape of the pyrotechnic projectile. Hence, such manufacturing variations can create an outer shell that is non-uniform in shape, which causes undesirable drag and instability in flight. As a result, the altitude to which the pyrotechnic projectile is launched can never be determined with precision. In addition to the structural variations in the pyrotechnic projectile outer shell structure, the variations in the quality and composition of the black powder charge used in the initial burst can propel otherwise identical projectiles to various different heights. This is explained in more detail below.

A further related factor regarding altitude is the main fuse technology, which governs detonation timing of the main burst after ignition of the initial burst. The main fuse, used to detonate the main burst of the pyrotechnic projectile, typically is a delayed chemical fuse. Existing chemical fuses are usually non-uniform in their construction and therefore exhibit a wide variation in their burn rate from one pyrotechnic projectile to the next. As a result, it has been found that a pyrotechnic projectile set to detonate at approximately 600 feet in the air may detonate anywhere from between 500 feet and 700 feet, roughly a 16 percent deviation.

Variations in black powder composition, black powder quality, pyrotechnic projectile structure and mortar structure all contribute to the inherent lack of uniformity of projectile height and position at the time of shell ignition. Amounts of black powder in the initial burst, length and orientation of the initial and main fuses, and composition and thickness of the shell casings are only within tolerances obtainable during non-precision hand manufacturing. Because of the lack of precise repeatability during pyrotechnic projectile manufacturing, large variations between the pyrotechnic projectile's ignition time and flight path from pyrotechnic projectile to pyrotechnic projectile are the norm. Historically, fireworks displays have not been precise, repeatable or accurate. However, although it is not possible to exactly duplicate any one display, by using different types of stars and/or flash-and-sound powder, and by arranging them in the shell in a particular way, various types of fireworks displays can be created when a variety of such pyrotechnic projectiles are ignited simultaneously or in series.

From the foregoing, it can be seen that the typical pyrotechnic projectile is a self-contained unit having its means of propulsion (i.e., the initial burst) and mechanism for timing projectile detonation (i.e., the initial and main fuses) incorporated into its structure. As such, these propulsion and timing mechanisms are fixed by the structural composition of the pyrotechnic projectile, which is pre-set at the factory. Hence, it is not possible to adjust those parameters once the manufacturing process for the pyrotechnic projectile has been completed.

Accordingly, it further can be seen that the launch and detonation of existing pyrotechnic projectiles is an inexact science and is subject to severe limitations and drawbacks. To determine the pyrotechnic projectile path and altitude achieved, the amount of black powder in the initial burst is significant, since a greater amount of black powder generates a larger gaseous expansion within the mortar behind the pyrotechnic projectile and a resultant higher projection into the sky. The limitation on the height of the projection is based on the minimum burn rate of the black powder, inasmuch as the rate of pressure increase cannot exceed that which the inner shell can withstand, i.e., structural integrity of the inner shell of the pyrotechnic projectile must be maintained.

For any given size of shell there is a practical limit to the altitude that can be reached using black powder as the initial burst component. Increasing the altitude requires increasing the acceleration rate up the length of the mortar, and therefore increasing the burn rate of the initial burst. However, as the initial burst is formulated to burn faster, it becomes less controllable; as the rate of pressure rise increases, the initial burst is consumed quicker and begins to exhibit explosive detonation characteristics. The result is an exponential pressure rise that will destroy a pyrotechnic projectile in the mortar.

Increasing the force which the inner shell casing can withstand, for example, by increasing the shell thickness, causes a change in the pyrotechnic projectile's performance. This change in performance, which can cause a change in the characteristics of a fireworks shell, is disfavored because it usually diminishes and/or alters the visual display quality. Consequently, the projection height of the pyrotechnic projectile is limited by the durability of the shell. Historically, it was not possible to project the pyrotechnic projectile beyond a certain height, relative to its diameter. For example, a pyrotechnic projectile having a nominal six inch shell casing typically can be launched to an altitude of between about 200-600 feet, with 600 feet being the practical limit. A pyrotechnic projectile having a smaller shell casing will go lower and one with a larger casing will go higher, with 1,000 feet being about as high as they will go.

As noted above, the pyrotechnic projectiles are directed into the air through the mortars. The mortars are cylindrical in shape. To propel the pyrotechnic projectile from the mortar, the pyrotechnic projectile is placed in the mortar. The mortars can be constructed of any rigid material such as cardboard, metal or plastic. The pyrotechnic projectile has a specific orientation within the mortar. The orientation provides for the outer shell having the initial burst to be arranged so that it is below the main burst. This type of fireworks display system also produces a loud noise, from detonation of the initial burst, requiring ear protection at the launch site. There is no existing method of noise reduction for the prior art devices. Moreover, existing mortar construction generally is not conducive to adjustment after installation at the launch site to enable aiming of the pyrotechnic projectile to different locations in the sky.

Another drawback associated with existing pyrotechnic projectiles and mortars is their adverse impact on the environment. For example, the current method of projection using a charge of black powder forms a residue having a detrimental environmental impact on the ground and any water area in and around the firing site. The black powder, products of combustion, and products of incomplete combustion from the pyrotechnic projectile firing are extremely corrosive agents (e.g., various acids). These materials, in addition to corroding the existing equipment at the site, are deposited in the area surrounding the mortar site, both on the ground and in the water. There are significant adverse effects from this deposition of sulfuric acid and other harmful chemicals on the soil and water surrounding the site. Moreover, on the ground, at the time of firing, there are large quantities of smoke. This smoke can be very distracting to the guests and may direct their attention away from the aerial fireworks display. In addition, large quantities of smoke may be blown by the wind toward the guests, causing further irritation.

Fallout from the pyrotechnic projectile after it has been detonated in the air creates further environmental concerns. Firework shell casings are traditionally made from laminated paper or plastic. Paper casings have been in use since the time of Marco Polo, whereas plastic casings were introduced approximately 25 years ago. Existing pyrotechnic projectile shells are not usually completely fragmented and consumed in the air during detonation of the pyrotechnic projectile into its intended display. Instead, the shells are incompletely fragmented, and many portions of the shell, some of them quite large, fall back to the ground. This creates undesirable litter in an area below the point of the fireworks display. Portions of the shell falling back to the ground also cause a safety hazard to people on the ground who could be hit and injured by the fallout. Moreover, after detonation, portions of the shell can and often do fall back to the ground as burning debris. This causes a severe fire hazard in many areas.

In spite of the inability to precisely control fireworks displays, no change from the existing system has ever been successful because of the inability to detonate the main burst of the pyrotechnic projectile by means other than ignition by the initial burst. As previously discussed, because the black powder provides the propelling charge necessary to ignite the main fuse of the pyrotechnic projectile, use of any other type of propulsion means that does not incorporate black powder or its equivalent does not provide for delayed aerial detonation.

In view of the inaccuracy and drawbacks possessed by existing pyrotechnic projectiles and mortars, serious limitations are imposed on the versatility of the resulting pyrotechnic display. For example, the limited capability to aim the pyrotechnic projectile and control its trajectory inhibits the ability to send a pyrotechnic projectile to different locations of the sky having different altitudes. The lack of precision and timing regarding detonation of the projectile in the air prevents precise timing of the main burst explosion. Moreover, fireworks shows cannot be precisely presented in synchronization with programmed material, such as music and dialogue, nor is it possible to repeatably and consistently produce a fireworks pattern corresponding to a recognizable shape, in view of the inaccurate and random nature of firing of the main burst. The relatively high volume of black powder used in the initial burst, as well as the main burst, also requires that the projectile be treated with special care and handling during transportation. In this regard, there are strict statutory shipping requirements for hazardous materials which govern the handling and transportation of the pyrotechnic projectiles. These factors consequently increase fireworks display expense.

Accordingly, there has existed a definite need for a method and system for launching and detonating projectiles which is more accurate, safe and versatile, with a minimum adverse environmental impact. The present invention satisfies these and other needs, and provides further related advantages.

SUMMARY OF THE INVENTION

The present invention provides a system and method for creating a precision fireworks pyrotechnic display that is highly accurate and safe, with greater altitude capability and a substantially decreased environmental impact. The system comprises a launching device for launching a fireworks projectile into the air, and an electronic control system including a controller and an electronic fuse. The electronic fuse is connected to the projectile and can communicate with the controller such that the projectile explodes in the air into a fireworks display after a predetermined time period. The launching device also advantageously uses a remote, non-explosive launching medium to rapidly expel the projectile into the air. The system of the present invention furthermore is intended to be simple in construction, reliable in operation, and low in maintenance.

More particularly, the new projectile comprises a shell having a main burst only. This main burst is still designed to explode into the pyrotechnic display upon ignition by the electronic fuse. However, the shell no longer is limited in its thickness and structure and can be constructed from various materials including a composition which is a consumable binding agent, such as paper or plastic material. The composition of the shell can also include an additive such that, upon ignition, the shell is exploded along with the main burst charge into small particles that are rapidly burned and consumed. As a result, only lightweight, inert particles fall to the ground, virtually eliminating any safety or fire hazard, and with minimum environmental impact. Elimination of the black powder ignition at ground level for the initial burst, as in the prior art system, also reduces the environmental impact.

In one aspect of the invention, the additive forming the shell composition is nitrocellulose. Varying shell structures with different nitrocellulose compositions have been found suitable to completely burn and consume the shell. A composition having a range of about 0.6 gm/cm$^3$ to about 1.3 gm/cm$^3$ nitrocellulose has been used in combination with a plastic binding agent, but various other ranges and other additives may be used to accomplish the desired result. In one embodiment, the nitrocellulose is mixed with the binding agent before forming the projectile shell. In another embodiment, the binding agent is first formed into the shell, with the nitrocellulose being applied to an inner surface of the shell. The shell can take on various shapes, such as cylindrical, spherical and bullet-shaped. The shell thickness also can be appropriately adjusted depending on the pressure change to which the projectile will be subjected.

In another aspect of the invention, the surface of the projectile shell may be scored to facilitate exploding of the shell into small particles upon detonation in the air after launch. In one form, the inner surface of the shell is scored with grooves in the form of intersecting lines. In another embodiment, the inner surface of the shell contains ridges which also intersect each other. Thus, when the projectile explodes in the air, it is completely fragmented into tiny particles which, as noted above, fall harmlessly to the ground as inert flakes.

The system for creating the fireworks display of the present invention uses a launching device in the form of a launcher having a non-explosive launching medium to launch the projectile. In the preferred embodiment, the non-explosive launching medium is a compressed gas, such as air from a conventional pressurized air source. By using a non-explosive, remote launching medium, the need for a black powder initial burst and all of its associated problems are totally eliminated. It is also possible to transport the projectile at decreased costs since it is not as explosive as its prior art counterpart.

In accordance with the invention, the launcher comprises a pressure tank containing compressed gas and a launching tube having a lower end connected to the pressure tank and an open end for expelling the projectile into the air. A valve connected between the pressure tank and the launching tube is opened and closed in a precise and controlled manner to accurately introduce an exact, predetermined amount of gaseous medium, at a controlled pressure, from the pressure tank to the launching tube. Upon release, the pressure of the gaseous medium rapidly expels the projectile from the open end of the tube. Typical velocities are in the 500 ft./sec. range. Pressures ranging from 20 psi to 150 are typically used to launch the projectile to precise altitudes ranging from 50 feet to 2,000 feet in the air or higher. Because the launcher of the present invention accelerates the projectile by releasing compressed gas behind the projectile, the maximum pressure is limited, and the pressure rise never becomes uncontrollable. This allows a higher pressure rise to be used, resulting in a higher projectile acceleration and higher altitudes, while staying well below the pressure that could damage the projectile.

In one aspect of the invention, the launcher includes a breech positioned between the pressure tank and the launching tube for loading the projectile into the launcher. One embodiment of the breech comprises a half-cylindrical opening in the lower end of the launching tube through which the projectile is loaded upwardly into the launching tube. A stop mechanism, in the form of a pivoting bar connected to the side of the opening, holds the projectile in a fixed position within the launching tube at a location above the breech. A sleeve surrounding the launching tube is adapted to slide axially with respect to the tube between an open position, in which the sleeve is spaced axially from the opening to permit loading, and a closed position, in which the sleeve covers the opening to permit launching. In another embodiment of the breech, instead of a sleeve the breech includes a door pivotally connected to the breech such that, in the open position, the door pivots outwardly away from the opening to permit loading and, in the closed position, the door pivots inwardly to cover the opening to permit launching. Other embodiments of the breech are used, such as a multiple breech apparatus.

The launcher also advantageously includes an aiming apparatus for accurately adjusting the angle of the launching tube with respect to the ground to thereby change the altitude and trajectory of the launched projectile. In one embodiment, the aiming apparatus comprises a plurality of legs which support the launcher. The length of these legs is adjustable to lower or raise one side of the launcher with respect to the other. This changes the angle of the launching tube with respect to the ground and thus the trajectory and altitude of the launched projectile.

The projectile launching system further includes an electronic fuse for igniting and detonating the explosive charge inside each projectile. The electronic fuse provides an extremely precise delay time from launch time to ignition of the projectile. It also decreases the chance of a premature post-launch ignition or an accidental ignition during ground handling. Each launcher in the system is controlled by a local control unit which provides the required electrical energy and data signals to store a predetermined ignition delay time in the fuse, to initiate a launch and to provide electrical energy to the fuse. Each local control unit is controlled by a central controller and can control one or more launchers. The central controller includes a programmable computer that accepts input commands from an operator, a display that displays system messages and a processor that provides appropriate signals to the local control units for launch communications and control.

The predetermined delay time set by the local control unit is the amount of time desired to pass from the time of launch to the time the projectile is ignited and detonated in the air. Prior to launch, the central controller commands the local control unit to provide the predetermined delay time to the electronic fuse. The local control unit receives a confirmation signal after the predetermined delay time has been loaded into the fuse. This confirmation signal assures that the fuse is functioning properly. After receipt of the confirmation signal, the local control unit sends a start command to the fuse and to the launcher. In response, the control unit opens the valve and admits a predetermined amount of pressure from the pressure tank to the launch tube for a predetermined time period to launch the projectile from the tube. After the projectile has been launched, the fuse confirms that a launch has actually taken place and, if so, waits for the predetermined delay time before initiating ignition of the main burst charge inside the projectile shell. If the fuse does not confirm that a launch has taken place, the fuse is reset. The local control unit can then signal that an error has taken place or it can re-initiate the launch sequence.

The electronic fuse and its associated control system provide many advantages. Chief among them is the ability to provide more precise projectile detonation times after launch. The fuse used in the present invention provides a detonation time having an accuracy within 25 milliseconds. When this accuracy is combined with the ability of the launch tube to launch the projectile to relatively precise altitudes, detonation of the projectile at a selected location in the sky can be achieved. By appropriately programming the central controller, a multitude of projectiles can be launched simultaneously or in series to create a pattern in the sky upon detonation or to detonate in a manner that is synchronized with a particular musical score, dialogue or other sounds.

Other features and advantages of the present invention will become apparent from the following detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
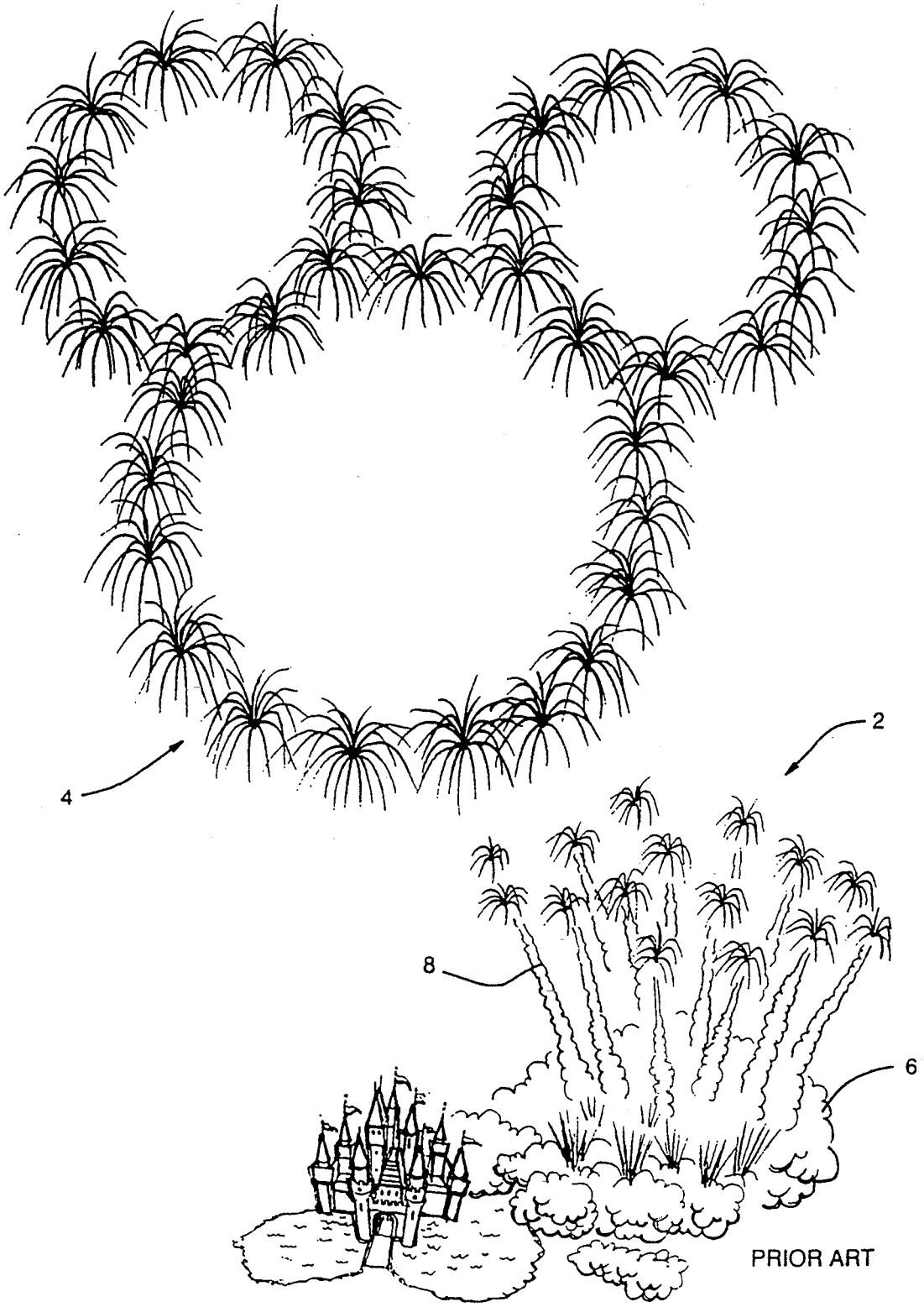
FIG. 1 is an aerial perspective view of a fireworks display, showing a display created by existing prior art fireworks technology alongside a display created by the method and system of the present invention.

As shown in the accompanying drawings, the present invention is embodied in a system and method for propelling fireworks projectiles to accurate locations in the air and detonating them in a repeatable and consistent manner to create an enhanced pyrotechnic display. The system comprises a fireworks projectile 10 and a launcher 12 for launching the projectile to precise altitudes, in some cases as much as three or more times higher than existing systems. The launcher 12 advantageously uses a non-explosive launching medium to launch the projectile 10 into the air and an electronic fuse 14 connected to the projectile to explode it in the sky within a very precise time period after launch. The system further includes a central control system 15 for controlling one or more launchers 12 and electronic fuses 14. This system and method provides an improved fireworks show with increased range and accuracy, precision display choreography, and reduced environmental impact.

FIG. 1 is an aerial perspective view of two fireworks displays 2 and 4. The display 2 on the lower right portion of FIG. 1 illustrates the type of limited, imprecise and low altitude fireworks display that is achieved using existing prior art fireworks technology. There it can be seen that detonation of the initial burst has caused noticeable quantities of smoke, indicated by the reference numeral 6, on the ground in the area of the mortars where it may be distracting to guests observing the display 2. As each prior art pyrotechnic projectile is propelled in the air, it also leaves a long trail of smoke 8 that is also quite noticeable. Moreover, when the prior art pyrotechnic projectile detonates into its intended display, assuming each pyrotechnic projectile is launched simultaneously and designed to explode at the same altitude, they will not detonate at the same time or at the same altitude. This results in a very imprecise, random and low altitude fireworks display 2.

In contrast, the fireworks display 4 in the upper portion of FIG. 1 illustrates the type of versatile, precise and high altitude fireworks display that can be achieved using the method and system of the present invention. With this new and enhanced display 4, there is no undesirable smoke on the ground nor are there any noticeable trails of smoke to detract from the display. Moreover, the launching and detonation of the projectiles 10 can be carefully and precisely controlled by the control system 15 to detonate the projectiles in such a way that the aerial explosions create a pattern of a desired shape. In this way, the pyrotechnic display 4 can be varied and enhanced without limitation to create a multitude of display patterns. Moreover, the projectile explosions forming the display 4 can be synchronized to follow music, dialogue or other sounds.

Figures 2A, 2B:
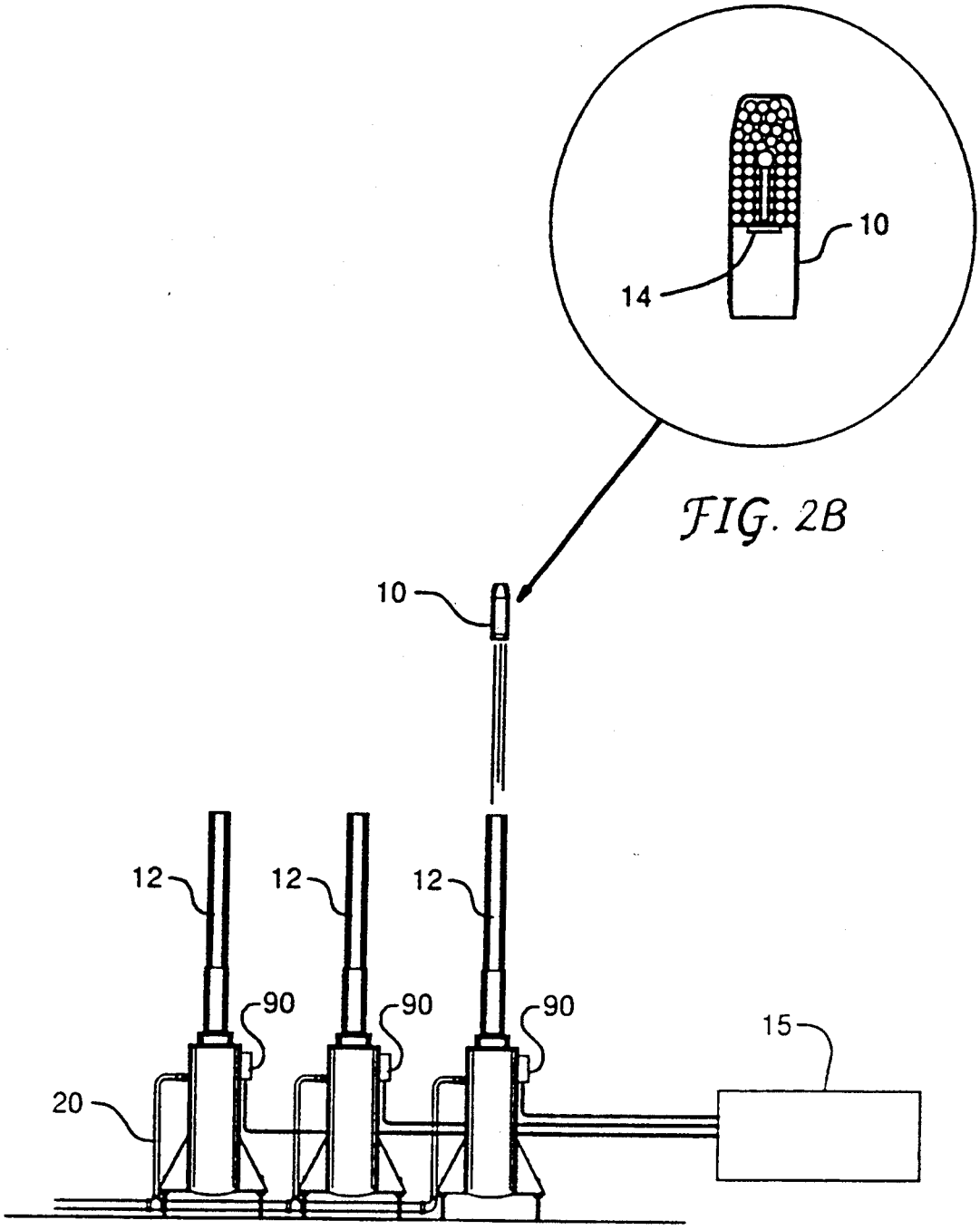
FIGS. 2A and 2B show a preferred embodiment of the invention, with FIG. 2A showing an elevational view of all the described components of the system, and with FIG. 2B showing an enlarged cross-sectional view of a pyrotechnic projectile of the system.

FIGS. 2A and 2B show a preferred embodiment of the invention and illustrate the major components of the system. This system comprises the projectile 10, also shown in an associated exploded view in FIG. 2B, and a plurality of the launchers 12 for launching the projectiles into the air. As noted above, each launcher 12 advantageously uses a non-explosive launching medium to rapidly expel the projectile 10 from the launcher where it is detonated at a precise location in the sky by the electronic fuse 14. As explained in more detail below, the system and method of the present invention provide a pyrotechnic display having features and advantages which have not previously been attainable with existing pyrotechnic display equipment.

Figure 3:
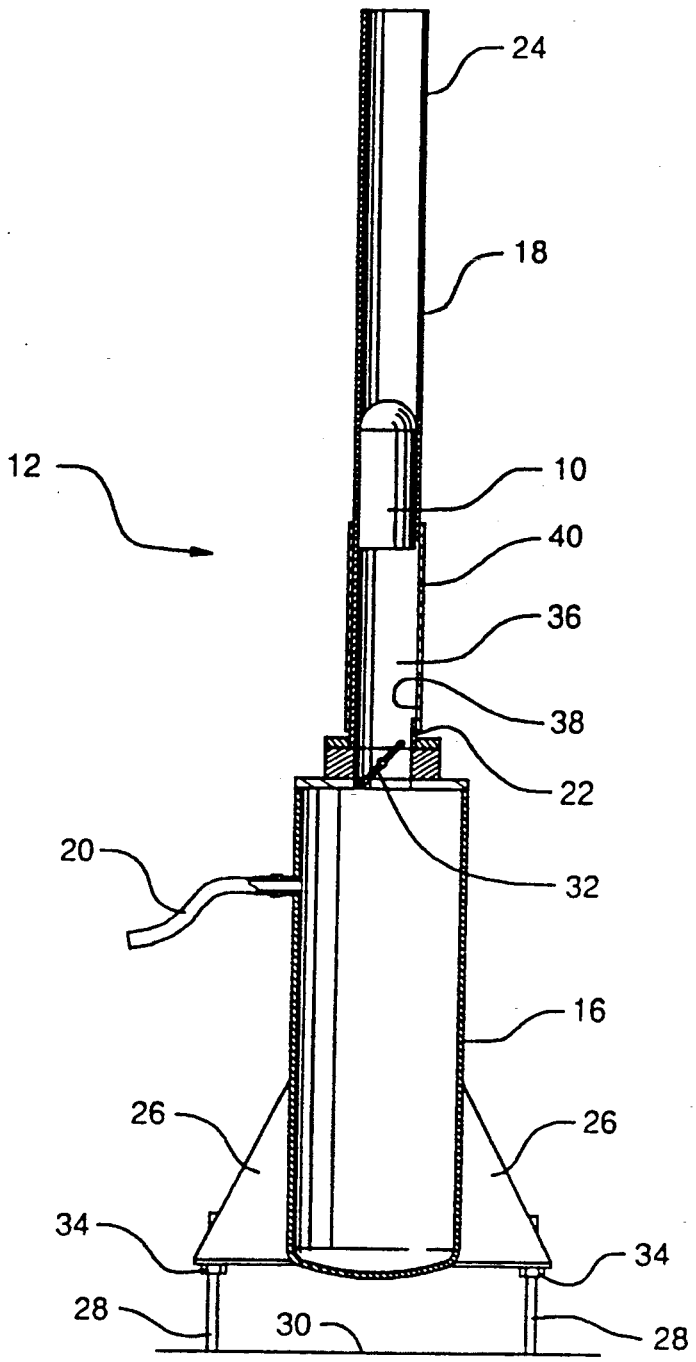
FIG. 3 is a cross-sectional elevational view of a launcher for launching a pyrotechnic projectile of the system.

FIG. 3 shows the structure of the launcher 12 in more detail. The launcher 12 comprises a pressure tank 16 and a launching tube 18 containing the projectile 10 to be launched. The pressure tank 16 contains a compressed gas, such as air, supplied to the tank from a compressed gas source (not shown) by a suitable hose 20. The launching tube 18 has a lower end 22 connected to the pressure tank 16 and an open, upper end 24 for expelling the projectile 10. The launching tube 18 may be cylindrical, as illustrated in FIG. 3, or it may be another appropriate shape to accommodate the shape of the projectile 10 being launched. The lower portion of the pressure tank 16 has a plurality of stabilizers 26 in the form of triangular-shaped flanges connected to a corresponding number of support legs 28 which support the launcher 12 on a relatively horizontal ground surface 30 or other platform. To adequately support the launcher 12, there should be at least three stabilizers 26 and support legs 28. However, additional stabilizers 26 and support legs 28 may be provided as may be necessary or desired.

The introduction of pressure from the pressure tank 16 to the launching tube 18 is controlled by a valve 32 connected between the launching tube 18 and the pressure tank 16. When it is desired to launch the projectile 10 and the pressure tank 16 is at the appropriate pressure level, the valve 32 is opened for a predetermined period of time to allow an exact volume of compressed gas to enter the lower end 22 of the launching tube 18 underneath the projectile 10. The force of the compressed gas rapidly accelerates and expels the projectile 10 from the open end 24 of the launching tube 18. By accurately controlling the pressure in the tank 16 and the amount of pressure admitted into the launching tube 18 by the valve 32, the projectile 10 can be launched into the air to a relatively precise altitude and at a relatively precise velocity. In the preferred embodiment of the invention, the pressure tank 16 is pressurized to levels from 20 psi to 150 psi to enable launching of the projectile 10 to altitudes ranging from 50 feet to 2,000 feet or higher, with tube exit velocities as high as 500 ft./sec.

The valve 32 which opens and closes to admit pressure from the pressure tank 16 into the launching tube 18 can be of any suitable construction, so long as it is fast acting, with a minimum opening time on the order of 12 milliseconds. It also must be capable of withstanding the pressures involved. In one embodiment of the invention, a butterfly valve has been used. Suitable butterfly valves are available from Fisher Controls, such as an 8 inch valve identified as Type 1066, Body 8522. The pressure tank 16 preferably is constructed from metal, and the launching tube 18 may be constructed from suitable rigid materials, such as metal, plastic or fiberglass. When fiberglass materials and the like are used, it may be desirable to add an internal coating designed to reduce the charge created in the launching tube 18 during launching of the projectile 10.

The stabilizers 26 and support legs 28 described above are adjustable with respect to each other to enable aiming of the launching tube 18. More particularly, the stabilizers 26 are connected to the support legs 28 by a connector 34, which may be a threaded nut on the support legs 28. By moving one or more of the connectors 34 axially with respect to the support legs 28, one side of the launcher 12 may be raised or lowered with respect to the other. This adjustment changes the angle of the launching tube 18 with respect to the ground 30. As a result, the trajectory of the launched projectile 10 may be controlled to aim the projectile to a particular location in the sky for detonation.

Since the launching medium used to launch the projectile 10 is non-explosive, there is no black powder charge as in the prior devices. As a result, there is no objectionable cloud of smoke causing a visual intrusion on the ground which might detract from the fireworks display. There also is no burning debris which may inadvertently ignite adjacent projectiles or other combustible materials in the surrounding area. Furthermore, the lack of a ground launching explosion eliminates the generation of corrosive agents or other harmful chemicals, which could corrode the launch equipment and surrounding area or otherwise cause a detrimental environmental impact in the launch area. Maintenance of the launch equipment also is kept to a minimum.

FIGS. 4–7 show one embodiment of a breech 36 for loading the projectile 10 into the launching tube 18. The breech 36 comprises an opening 38 in the lower end 22 of the launching tube 18 through which the projectile is loaded. Since the launching tube 18 in the preferred embodiment is cylindrical, the opening 38 is shown as being a half-cylindrical opening having an axial length that is slightly greater than the length of the projectile 10. The breech 36 also comprises a cover in the form of a cylindrical sleeve 40 which surrounds the launching tube 18. The sleeve 40 is adapted to be moved axially with respect to the launching tube 18 between an open position and a closed position. In the open position, shown in FIGS. 4–6, the sleeve 40 is axially spaced from the opening 38 to permit loading of the projectile 10 into the launching tube 18. In the closed position, shown in FIG. 7, the sleeve 40 covers the opening 38 to permit launching of the projectile 10.

Figure 4:
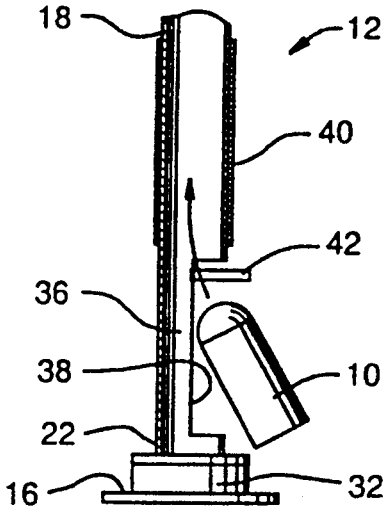
FIG. 4 is a cross-sectional elevational view of a portion of the launcher, showing one embodiment of a breech for loading the projectile into the launcher, with the breech in an open position for loading.
Figure 5:
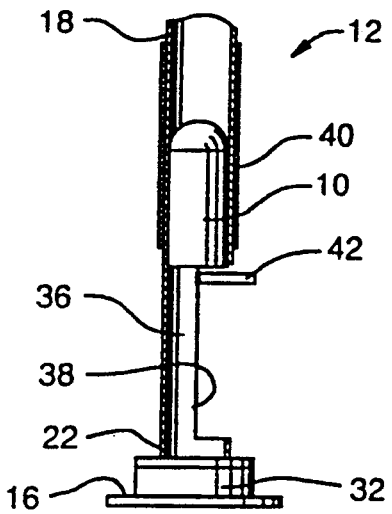
FIG. 5 is another cross-sectional elevational view of the launcher, similar to FIG. 4, showing a further stage of loading the projectile into the breech.
Figure 6:
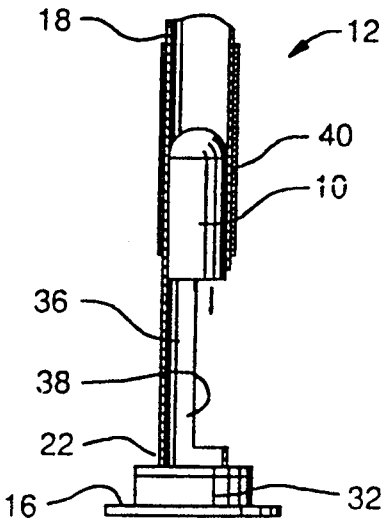
FIG. 6 is yet another cross-sectional elevational view of the launcher, similar to FIG. 4, showing a further stage of loading the projectile into the breech.
Figure 7:
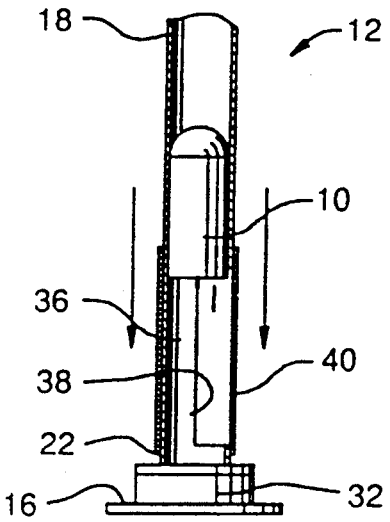
FIG. 7 is still another cross-sectional elevational view of the launcher, similar to FIG. 4, showing the final stage of loading the projectile into the breech.
Figure 8:
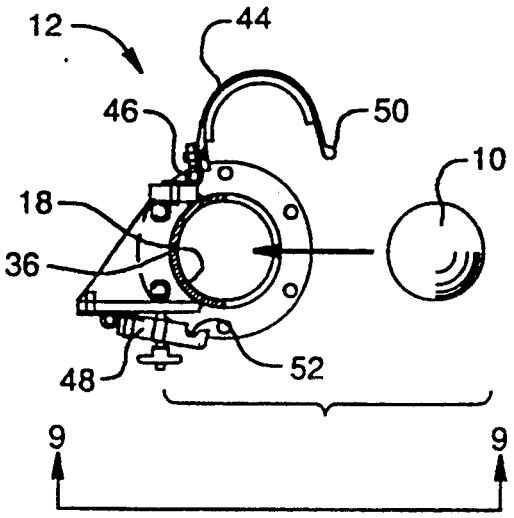
FIG. 8 is a cross-sectional plan view of a portion of the launcher, showing another embodiment of a breech for loading the projectile into the launcher, with the breech in an open position for loading.
Figure 10:
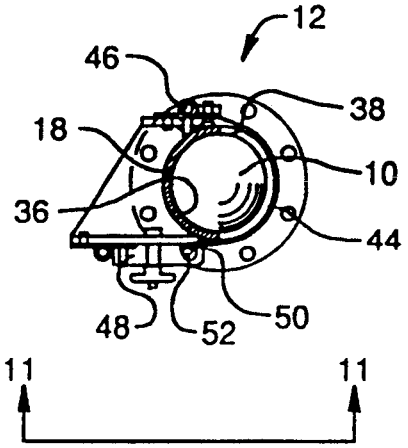
FIG. 10 is another cross-sectional plan view of the launcher, similar to FIG. 8, showing the breech in a closed position for launching.
Figure 9:
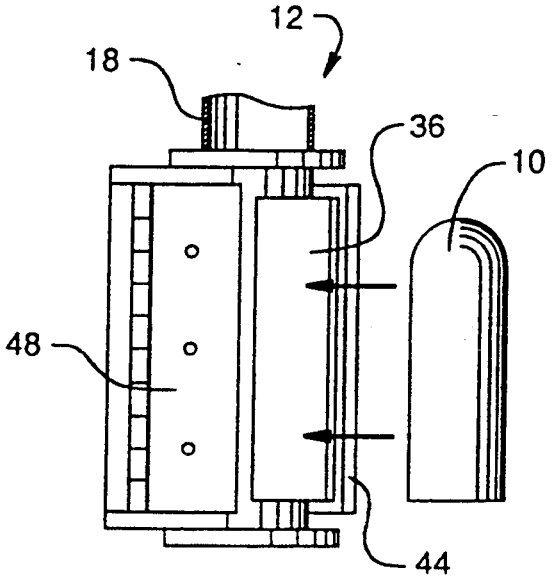
FIG. 9 is an elevational view of the launcher, taken substantially along the line 9—9 in FIG. 8.
Figure 11:
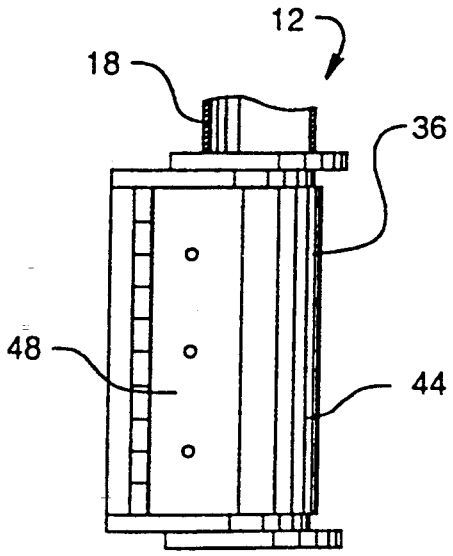
FIG. 11 is an elevational view of the launcher, taken substantially along the line 11—11 in FIG. 10.
Figure 12:
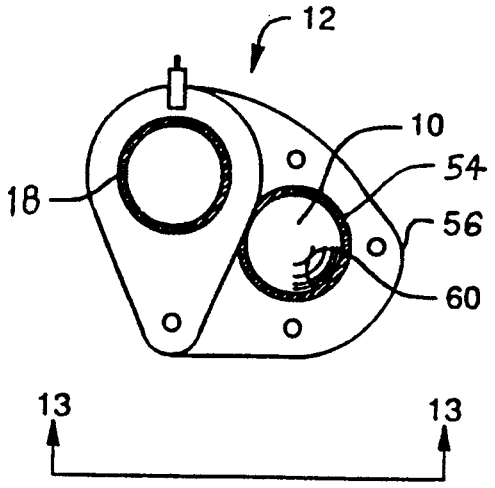
FIG. 12 is a cross-sectional plan view of a portion of the launcher, showing yet another embodiment of a breech for loading the projectile into the launcher, with the breech in an open position for loading.
Figure 14:
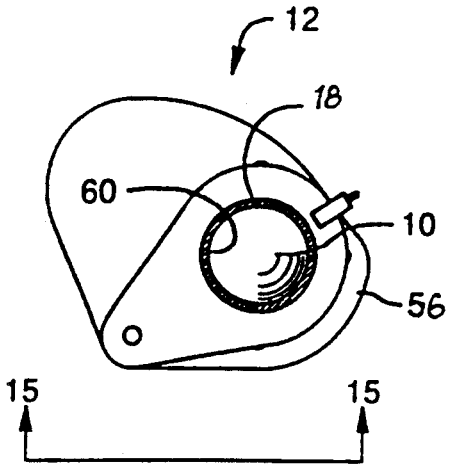
FIG. 14 is another cross-sectional plan view of the launcher, similar to FIG. 12, showing the breech in a closed position for launching.
Figure 13:
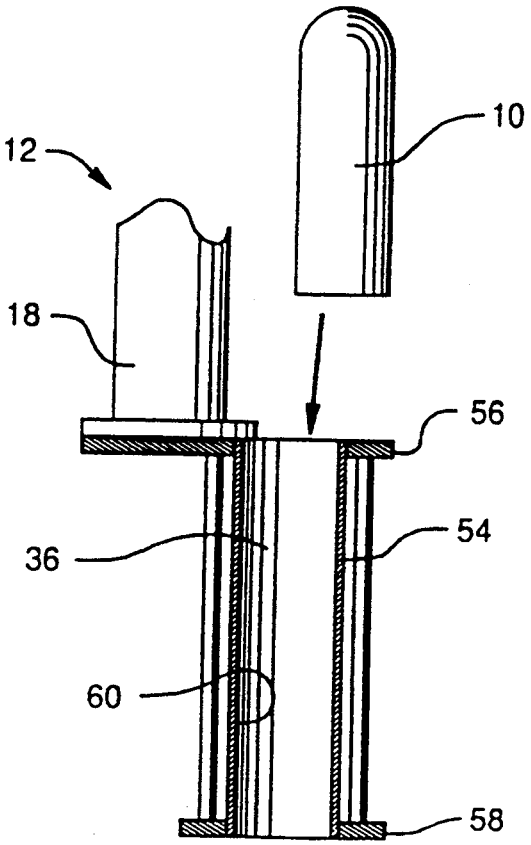
FIG. 13 is an elevational view of the launcher, taken substantially along the line 13—13 in FIG. 12.
Figure 15:
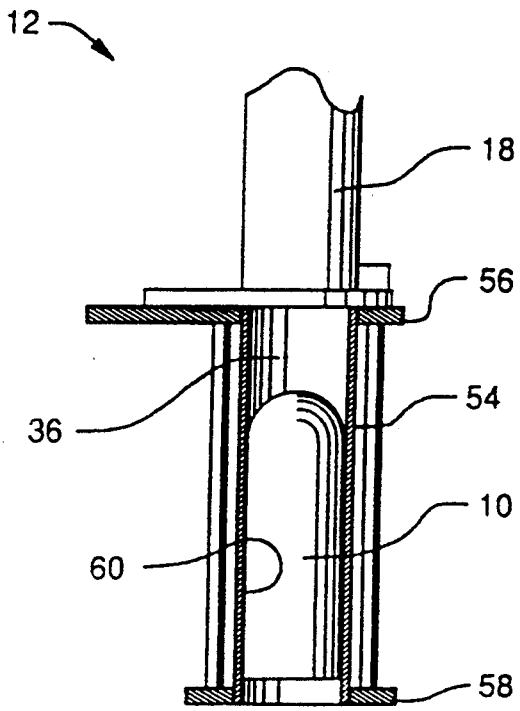
FIG. 15 is an elevational view of the launcher, taken substantially along the line 15—15 in FIG. 14.

In use, the sleeve 40 is moved to the open position and a bar 42, pivotally connected to one side of the opening 38, is pivoted outwardly away from the opening, as shown in FIG. 4. The projectile 10 is then inserted through the opening 38 and upwardly into the launching tube 18 at a location above the bar 42, as shown in FIG. 5. The bar 42, which is attached toward the upper end of the opening 38, is then pivoted inwardly toward the other side of the opening 38 such that the bar 42 is substantially aligned along a diameter of the launching tube 18. In this position, the bar 42 provides a stop mechanism for maintaining the projectile 10 at a fixed position within the launching tube 18, as shown in FIG. 6. To conclude the projectile loading operation, the sleeve 40 is moved axially downward to completely cover the opening 38, as shown in FIG. 7.

FIGS. 8–11 show another embodiment of the breech 36 for loading the projectile 10 into the launching tube 18. In this embodiment, the breech 36 includes the same half-cylindrical opening 38 in the lower portion of the launching tube 18, similar to the embodiment of the breech 36 discussed above in connection with FIGS. 4–7. However, instead of using a sliding sleeve 40 to cover the opening 38, the breech 36 includes a door 44 pivotally connected to one side of the opening 38. In the open position, shown in FIGS. 8–9, the door 44 is pivoted outwardly away from the opening 38 to permit loading of the projectile 10. In the closed position, shown in FIGS. 10–11, the door 44 is pivoted inwardly to cover the opening 38 to permit launching. The door 44, which is preferably half-cylindrical in shape, has one side pivotally connected to the launching tube 18 by suitable hinges 46 on one side of the opening 38. The other side of the door 44 is connected to the other side of the opening 38 by a suitable latching mechanism 48. The latching mechanism 48 illustrated includes a tongue 50 on the door 44 adapted to engage a groove 52 on the latching mechanism 48 to securely close the door 44 over the opening 38. It will be appreciated, however, that other appropriate latching mechanisms may be employed to secure the door 44 over the opening 38.

FIGS. 12–15 show yet another embodiment of the breech 36 for loading the projectile 10 into the launching tube 18. In this embodiment, the breech 36 comprises a cylindrical enclosure 54 having an upper flange 56 for pivotally connecting the launching tube 18 to the enclosure 54 and a lower flange 58 for connecting the enclosure to the pressure tank 16. The enclosure 54 includes a cylindrical tube 60 into which the projectile 10 is loaded. In the open position, shown in FIGS. 12–13, the launching tube 18 is pivoted outwardly away from the enclosure 54 to permit loading of the projectile 10. In the closed position, shown in FIGS. 14–15, the launching tube 18 is pivoted inwardly to align with the enclosure 54 to permit launching. Thus, by appropriately pivoting the launching tube 18, the launching tube 18 may be moved into and out of registration with the enclosure's cylindrical tube 60.

Figure 16:
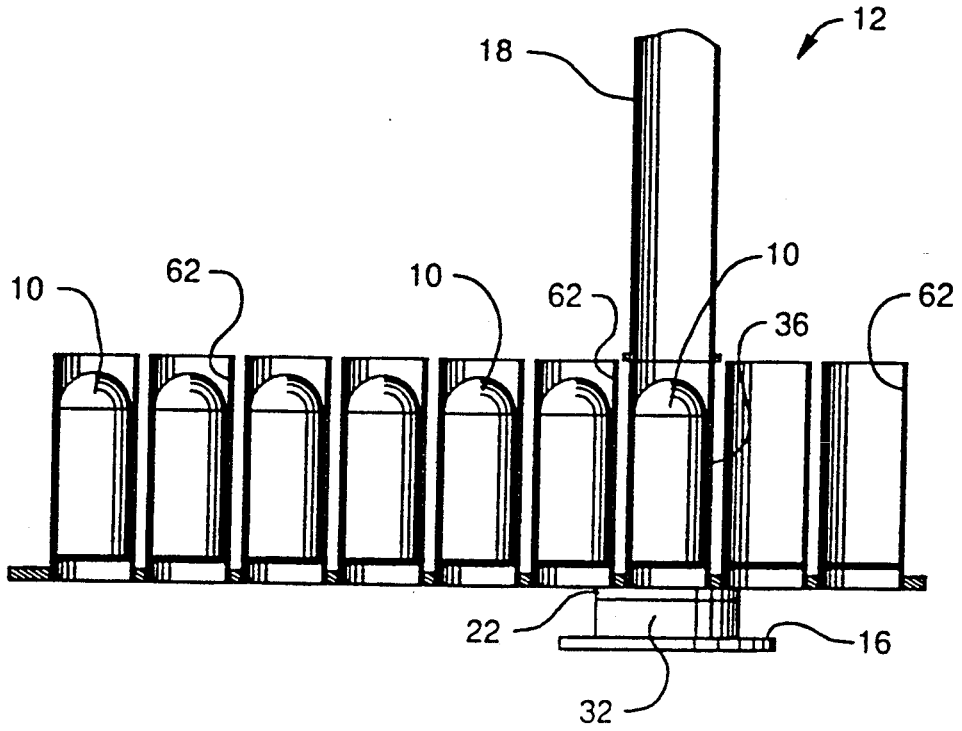
FIG. 16 is a cross-sectional elevational view of a portion of the launcher, showing a further embodiment of a breech for loading a plurality of projectiles into the launcher.

FIG. 16 shows yet another embodiment of the breech 36 for loading a plurality of projectiles 10, one at a time, into the launching tube 18. In this embodiment, the breech 36 includes a row of cylindrical tubes 62 containing the projectiles 10 to be launched. Each of the tubes 62 is moved successively into registration with the launching tube 18 after the projectile in the previous tube has been launched. In one embodiment of the breech, the cylindrical tubes 62 are arranged in a straight row, while in another embodiment the cylindrical tubes 62 may be arranged in a circular or cylindrical manner. Appropriate means (not shown) may be provided for indexing the cylindrical tubes 62 such that the projectiles 10 may be launched in succession at a predetermined time or rate.

Figure 17:
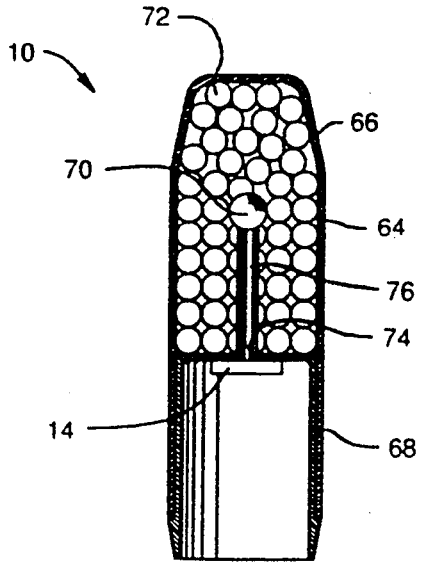
FIG. 17 is a cross-sectional elevational view of one embodiment of an assembled projectile in accordance with the present invention.

The projectile 10 used in the present invention is unique in both its structure and explosive properties. For example, the bullet-shaped projectile shown in FIGS. 17–18 comprises a projectile shell 64, including an upper shell 66 and a lower shell 68. The lower shell 68 contains an explosive burst charge 70 and a composition 72, such as stars or flash-and-sound powder, adapted to explode into the pyrotechnic display upon ignition and detonation of the explosive charge 70. The lower shell 68 also houses the electronic fuse 14, which ignites a squib 74 upon ignition sending a flame upwardly through a cylindrical sleeve 76 to detonate the burst charge 70. The sleeve 76 also holds and positions the burst charge 70 in place, surrounded by the composition of stars 72. In accordance with the invention, the shell 64 which contains the explosive burst charge 70 is constructed from a special composition comprising a consumable binding agent and an additive, such as an explosive additive. This structural composition of the projectile 10 advantageously provides a shell 64 that is exploded along with the burst charge 70 into small particles that are rapidly burned and consumed such that they fall harmlessly to the ground as lightweight, inert flakes.

In one preferred embodiment of the projectile 10, the binding agent is a paper or plastic material and the additive is nitrocellulose. Although the amount of nitrocellulose or other additive in the shell 64 may vary, a shell containing a range of between about 0.6 $gm/cm^3$ to about 1.3 $gm/cm^3$ nitrocellulose has been found to be suitable to cause rapid burning and consumption of the small particles of the shell following the explosion in the air. In one forth of the invention, the nitrocellulose is mixed with the fibers of the binding agent to form the shell 64. In another embodiment, the binding agent is initially formed into the shell 64 and the nitrocellulose is subsequently applied to an inner surface of the shell. The shell 64 may be formed by molding or other suitable techniques. It will be appreciated that other types of explosive or highly flammable additives may be used in appropriate amounts to ensure that, upon detonation, the exploded projectile shell particles will be rapidly burned and consumed before reaching the ground.

Projectiles 10 manufactured in accordance with the present invention preferably include a plastic binding agent, such as white fiber reinforced plastic, in combination with a nitrocellulose composition. This composition includes approximately 40–70 percent nitrocellulose, 15–40 percent cellulose, 7–13 percent cured polyurethane resin and 0.5 to 1.5 percent N'-methyl-N,N-diphenylures. Nitrocellulose compositions of this nature are available from Olin Corporation of Stamford, Conn. under Product Code DPE04000.

Figure 18:
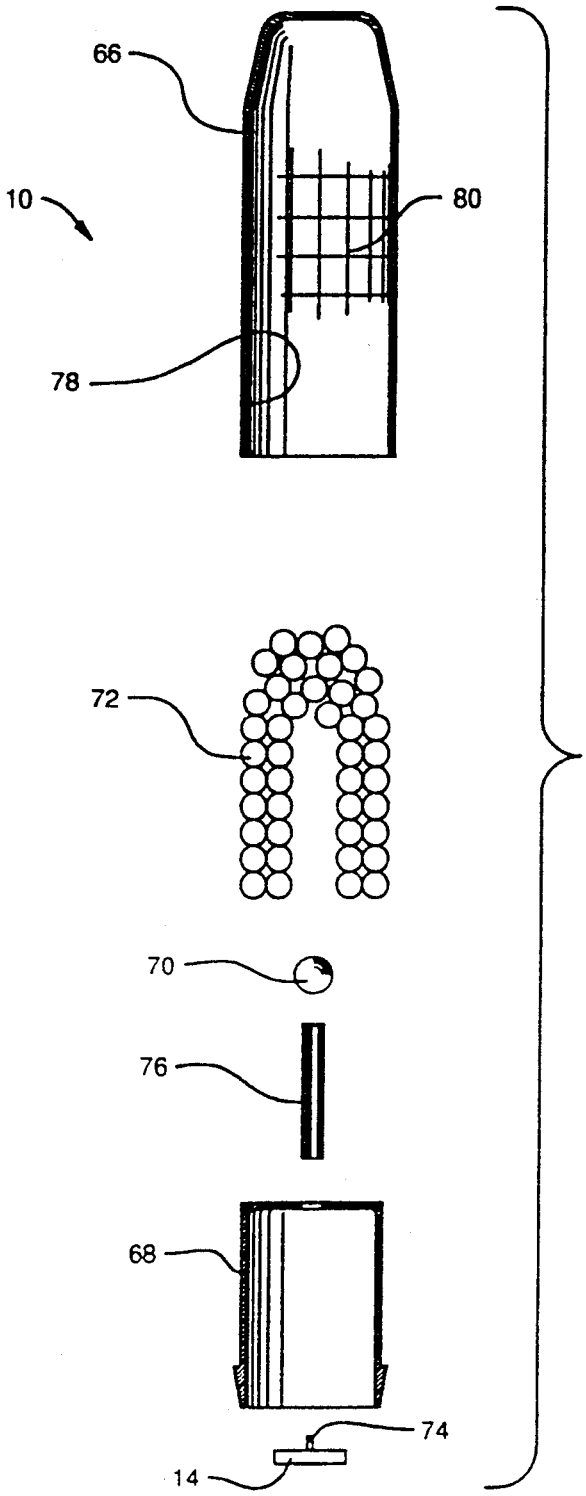
FIG. 18 is an exploded cross-sectional elevational view of the projectile of FIG. 17.
Figure 19:
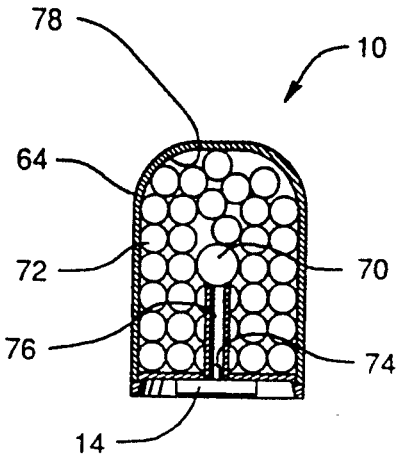
FIG. 19 is a cross-sectional elevational view of another embodiment of an assembled projectile in accordance with the present invention.
Figure 20:
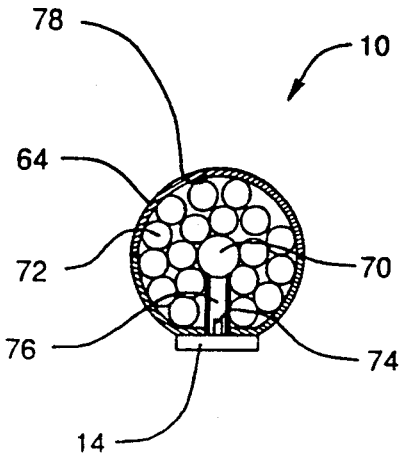
FIG. 20 is a cross-sectional elevational view of yet another embodiment of an assembled projectile in accordance with the present invention.

FIGS. 19–20 show other shapes of the projectile. For example, FIG. 19 shows a cylindrically shaped projectile 10, while FIG. 20 shows a spherically shaped projectile 10. Each of these projectiles 10 have the same components of the bullet-shaped projectile 10 shown in FIGS. 17–18, such as the explosive burst charge 70, a composition 72 such as stars, and a fuse 14. However, each of these differently-shaped projectiles 10 produces a different form of pyrotechnic display when exploded in the air. Accordingly, by appropriately selecting the projectile 10 having the desired pyrotechnic display properties, a variety of pyrotechnic displays can be achieved.

Figure 21:
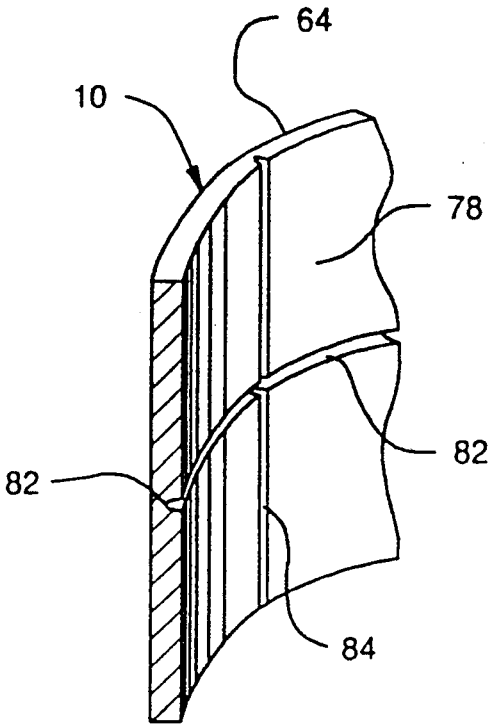
FIG. 21 is a perspective view of a portion of a projectile, partly in cross-section, showing scoring in the form of grooves on an inner surface of the projectile.
Figure 22:
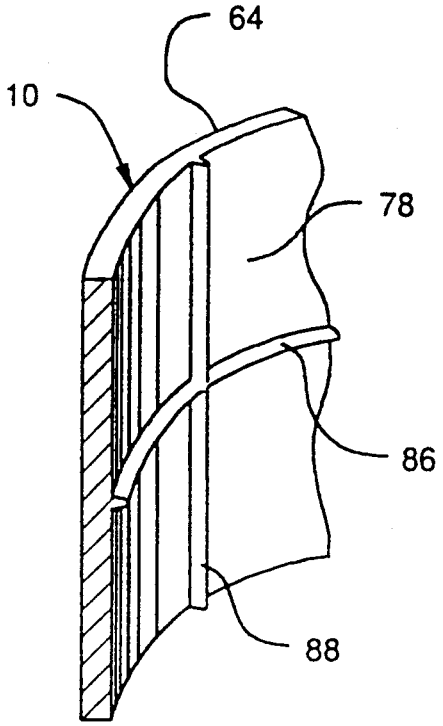
FIG. 22 is another perspective view of a portion of a projectile, partly in cross-section, showing scoring in the form of ridges on an inner surface of the projectile.

To facilitate exploding of the shell 64 into small particles when the explosive burst charge 70 inside the shell is detonated in the air, the inner surface 78 of the shell 64 is scored, as shown generally by the reference numeral 80 in FIG. 18. More particularly, in one preferred form, shown in FIG. 21, the inner surface 78 of the shell 64 is scored with a plurality of horizontal grooves 82 which intersect a plurality of vertical grooves 84. These grooves 82 and 84 extend into the projectile shell 64 a distance equal to approximately one-half the thickness of the shell. In another preferred form, shown in FIG. 22, the inner surface 78 of the shell 64 is scored with a plurality of horizontal ridges 86 which intersect a plurality of vertical ridges 88. These ridges 86 and 88 extend radially inward from the inner surface 78 of the shell 64 by a distance equal to approximately one-half the thickness of the shell. Appropriate molds can be formed to construct the shell 64 and form suitable grooves 82 and 84 or ridges 86 and 88 on the inner surface 78 of the shell to facilitate exploding of the shell into small particles when the explosive burst charge 70 inside the shell 64 is detonated in the air. For example, for a nominal six inch shell, the horizontal and vertical grooves and/or ridges can be spaced apart by about $\frac{3}{8}$ inch to 1 inch. Of course, it will be appreciated that other geometric patterns of grooves 82 and 84 and ridges 86 and 88 may be provided on the inner surface 78 of the shell 64 to accomplish the purpose of exploding the shell into very small particles upon detonation of the explosive burst charge.

Fallout from the projectile 10 after it has been detonated in the air has a substantially decreased environmental impact. Unlike prior projectile shells, which are not completely fragmented and consumed in the air upon detonation, the projectile shell 64 of the present invention is completely fragmented into extremely small particles which are rapidly burned and consumed before reaching the ground. Hence, there are no large or burning portions of the shell 64 falling to the ground which could cause a safety or fire hazard. Instead, only lightweight, inert particles fall lightly to the ground as harmless flakes producing the least possible environmental impact. In addition, the use of compressed gas to launch the projectile 10 allows the shell 64 to be somewhat thicker than before. This allows the projectile 10 to be launched to a higher altitude than its prior art counterpart, since the thicker shell can withstand higher launching pressures.

Figure 23:
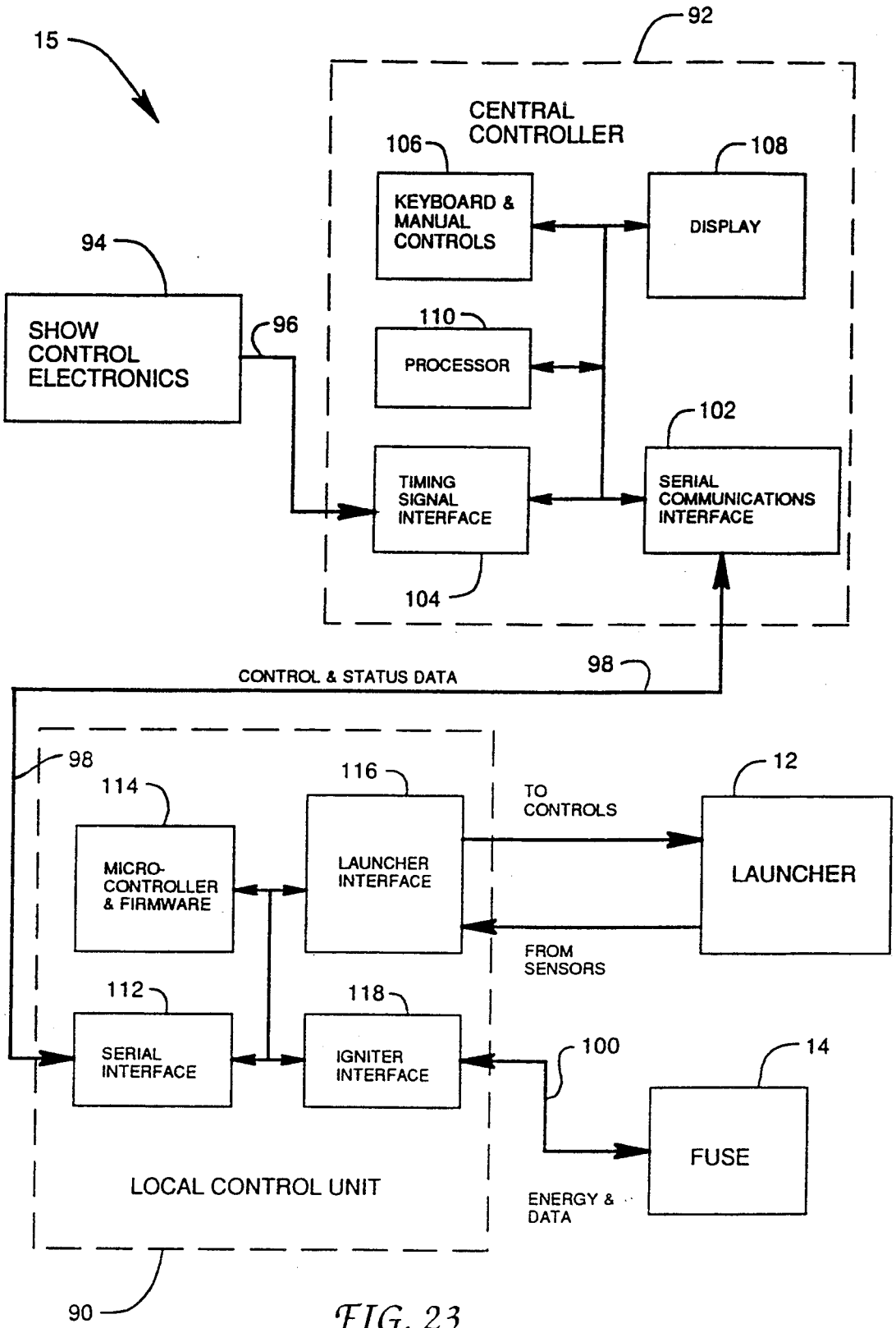
FIG. 23 is a block diagram showing a control system for launching the projectile from the launcher and detonating it in the air.
Figure 24:
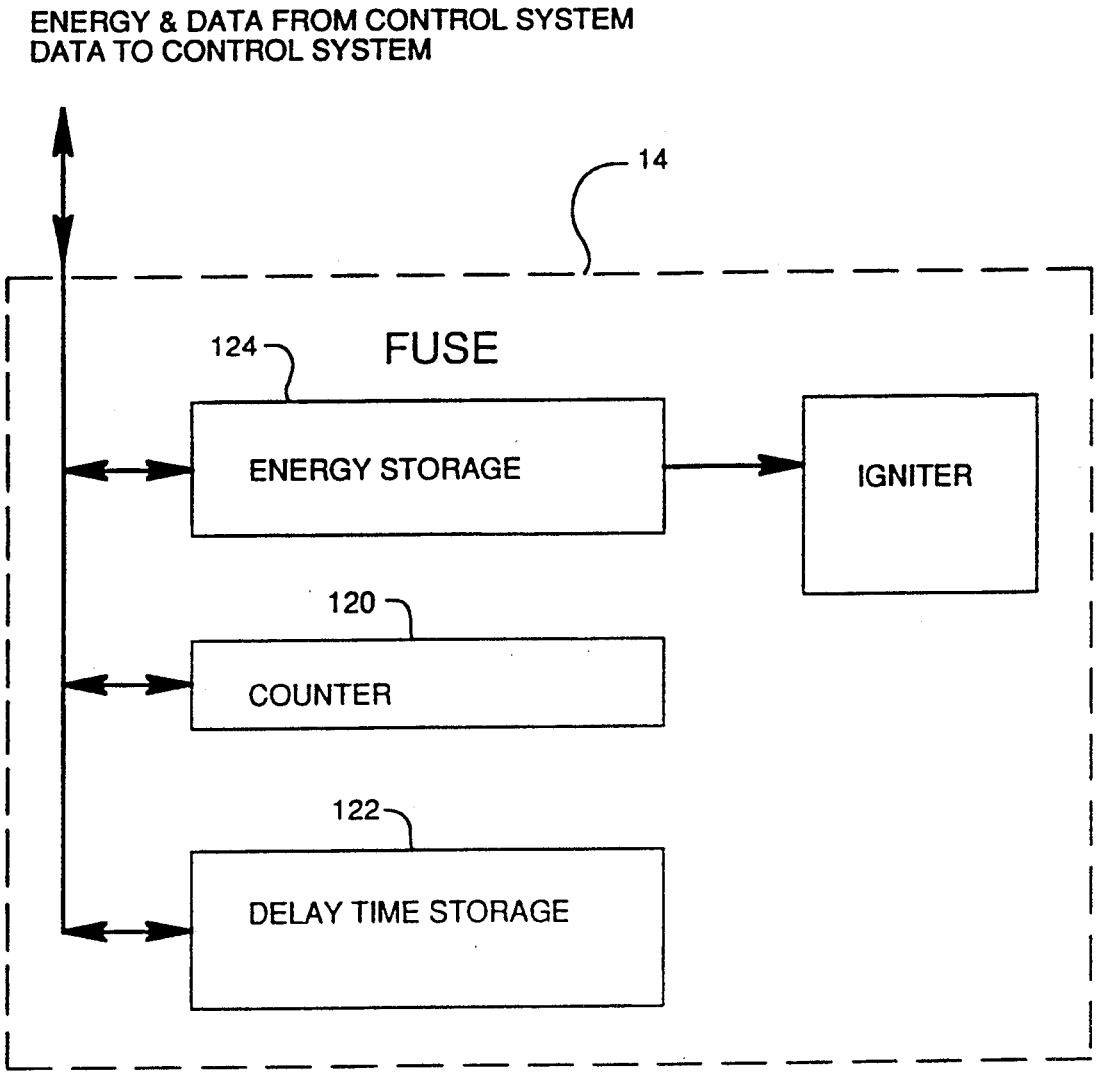
FIG. 24 is a block diagram showing in more detail the electronic fuse system and its connection to the control system.

FIGS. 23–24 show block diagrams of the pyrotechnic control system 15 and the electronic fuse 14 for igniting and detonating the explosive charge 70 inside each projectile 10. The electronic fuse 14 provides an extremely precise delay time from the time of launch to ignition of the projectile 10. In the preferred embodiment, the fuse has an accuracy within 25 milliseconds. The fuse also decreases the chance of a premature post-launch ignition or an accidental ignition during ground handling of the projectile 10.

Each launcher 12 in the control system 15 is controlled by a local control unit 90 which provides the required electrical energy and data signals to store a predetermined ignition delay time in the fuse 14, to initiate a launch and to provide electrical energy to the fuse 14 for ignition of the projectile 10. Each local control unit 90, which can control one or more launchers 12, is in turn controlled by a central controller 92.

The block diagram of FIG. 23 illustrates how show control electronics 94 provide timing signals via a signal line 96 to the central controller 92. As noted above, the central controller 92 communicates with the local control unit 90 that is associated with each launcher 12 of the pyrotechnic control system 15. In FIG. 23, the central controller 92 is shown connected to the local control unit 90 by a communication line 98. The local control unit 90 sends control data and receives sensor data from the launcher 12. The electronic fuse 14 associated with each projectile communicates with the local control unit 90 via a launch cord 100. The central controller 92 generates a control signal that causes the local control unit 90 to program the correct delay time into the electronic fuse 14. The local control unit 90 thereafter opens the valve 32, causing the projectile 10 to be launched. The projectile is then detonated at a predetermined time after launch and, therefore, at a predetermined location in the sky.

In one embodiment, the central controller 92 includes a serial communications interface 102 for communication with each local control unit 90, a timing signal interface 104 for receiving timing signals from the show control electronics 94, a keyboard and manual controls 106 and also a display 108 for interface with operators, and a processor 110 for controlling the interaction of these elements. The timing signal interface 104 is a combination of hardware and software that provides a signal to the processor 110 of the central controller 92 to automatically generate commands that are used to launch and fire the projectiles 10. Alternatively, the timing signal interface 104 can be configured to accept an external timing signal, such as time codes of the Musical Instrument Digital Interface (MIDI) design standard or of the Society of Motion Picture and Television Engineers (SMPTE), or to accept tone bursts or other digital signals. In this way, the pyrotechnic show control electronics 94 can be synchronized with these signals to time the detonation of the projectiles 10 in the air to correspond with the beat of music, dialogue or other sounds or visual displays.

The central controller 92 provides each local control unit 90 with control and status data over the communications line 98. The local control unit 90 is coupled to the communications line 98 via a serial interface 112. The serial interface 112 accepts data from the central controller 92 and formats the data into a form that is useable by a microcontroller 114 of the local control unit 90. The local control unit 90 operates under control of the microcontroller 114, which in turn communicates with the launcher 12 via a launcher interface 116 and communicates with the fuse 14 via a fuse or igniter interface 118.

The serial interface 112 includes data line protection components, a data line transceiver, addressing switches, and associated firmware for data encoding and error checking. The launcher interface 116 includes electronic and electromechanical components that are needed to receive and send control data from the launcher 12. The microcontroller 114 can be a programmable processor that sequences the launcher interface 116 and igniter interface 118 as well as senses the status of the interfaces through digital and analog input and output signals. The microcontroller 114 includes firmware and can also include data stored in ROM or EPROM.

The electronic fuse 14, shown in more detail in FIG. 24, communicates with the local control unit 90 via the igniter interface 118 and includes a counter 120 for producing a sequence of clock pulses and a delay time storage 122 for storing a count of the clock pulses. The electronic fuse 14 includes electrical storage components 124, such as capacitors, for storing electrical energy that is later released in a manner sufficient to ignite the projectile 10 after a sufficient number of clock pulses have been counted to constitute the desired delay time.

Prior to launch, the predetermined delay time is received by the electronic fuse 14 from the local control unit 90. A delay time confirmation signal is sent from the fuse 14 to the local control unit 90 and confirms proper functioning of the fuse. If the local control unit 90 does not receive the delay time confirmation signal, the local control unit can re-set the fuse 14 or the launch sequence can be halted. If the delay time confirmation signal is correctly received, indicating that the predetermined delay time has been correctly loaded, the local control unit 90 will send the fuse 14 and the launcher 12 a command signal to begin the launch sequence.

After the launcher 12 has pressurized the launching tube 18, the projectile 10 will start to rapidly move up the launching tube 18. Shortly after this movement begins, the launch cord 100 will be severed and the projectile 10 will clear the launching tube 18. The fuse 14 will detect this severing of the cord 100 as the absence of voltage at the fuse input terminal. The presence of a voltage at the fuse input terminal indicates that launch has not taken place. This will cause the fuse 14 to send a signal to the local control unit 90, which will reset the fuse. If a normal launch has occurred, the counter 120 in the fuse 14 will allow the predetermined time delay to pass and then will discharge the storage capacitors, igniting the projectile 10 and triggering the explosive burst charge 70.

In another embodiment of the invention, the control system 15 and its fuse 14 further include a counter 120 having a two-step sequence, comprising a pre-counter sequence and a launch sequence. This two-step sequence for fuse function is embodied in hardwired logic in the fuse 14. The two-step sequence may be preferred over the single step launch sequence described above, as it provides for additional safety and prevents interference from charge which may be found in the launching tube 18 during the launching operation.

The method of creating the pyrotechnic display and operation of the system will now be summarized in conjunction, for example, with the two-step sequence. Prior to the pyrotechnic display or show, the valve 32 in the launcher 12 is closed and the pressure tank 16 is pressurized to a low pressure. The control system 15 monitors this pressure to check for leaks. After disconnecting all power from the local control unit 90, an operator loads the projectile 10 into the breech 36 and secures it within the launching tube 18 after connecting the launch cord 100 between the projectile 10 and the local control unit 90. Closer to show time, the operator pressurizes the pressure tank 16 to the maximum system pressure and makes appropriate checks to ensure there is no error. The operator then vents the pressure tank 16 until it reaches a desired pressure level to launch the projectile 10 to a selected altitude. This pressure level is constantly monitored and adjusted until launch.

Prior to the launch, a DC voltage is applied across two input wires leading to the fuse 14. This current is monitored by the controller 92, and if no current is seen, the polarity is reversed. This allows the operator to connect the fuse leads 100 without checking polarity so that the connection is essentially foolproof. After hookup, an exponentially decreasing current should be seen, characteristic of a charging capacitor, which tells the operator to proceed to the next step. The controller 92 next sends a digital pulse train to the fuse 14 containing the value to load into the counter 120. After receiving this information, the fuse 14 sends a pulse train back to the controller 92 which uses this information to verify that the fuse 14 is operational and that it was programmed with the correct count.

After the fuse 14 has been charged, programmed and verified, a command by digital pulse train is sent from the controller 92 to the fuse 14 to start the pre-counter sequence. The pre-counter sequence is a safety device having two distinct purposes. First, it prevents dangerously short times from being programmed into the counter 120. Even if a time of zero has been programmed, the fuse 14 will not fire until the pre-counter time has elapsed. Second, it shields the fuse 14 from electrical noise during launch. When the command is given to start the pre-counter sequence, the inputs to the fuse 14 are disabled, so any noise picked up by the fuse leads 100 during launch, therefore, will be isolated from the fuse 14.

At the time the pre-counter sequence is started, the local control unit 90 opens the valve 32 and launches the projectile 10. The operator then checks the tank pressure to confirm that pressure was actually vented and launch has occurred. If not, the error is corrected. When the pre-counter sequence has elapsed, the fuse 14 re-enables its inputs. If the fuse 14 detects that it is still connected to the local control unit 90, then it knows that the projectile 10 has not been launched successfully and it immediately discharges its capacitor to a suitable ground and enters a safe state. However, if it sees that its leads 100 have been disconnected, the launch sequence counter 120 is started and, when the main count elapses, the squib 74 is fired by the fuse 14 sending a flame up the sleeve 76 to detonate the burst charge 70 of the projectile 10.

Figure 25:
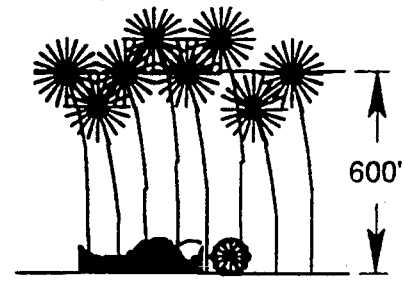
FIG. 25 is an elevational view representing a pyrotechnic display created by existing prior art fireworks technology.

FIG. 25 shows, in general, another type of limited pyrotechnic display 126 which the prior art systems are presently capable of achieving. In this example, the projectiles are designed to explode into the intended display at an altitude of approximately 600 feet. However, because the prior art pyrotechnic display systems are inherently prone to inaccuracy, for the reasons previously described, the projectiles will detonate at an altitude anywhere between 500–700 feet. This is a deviation of more than 16 percent. Moreover, even when these projectiles are all launched at about the same time, they generally will not explode simultaneously, primarily due to the lack of uniformity in chemical fuse construction.

Figure 26:
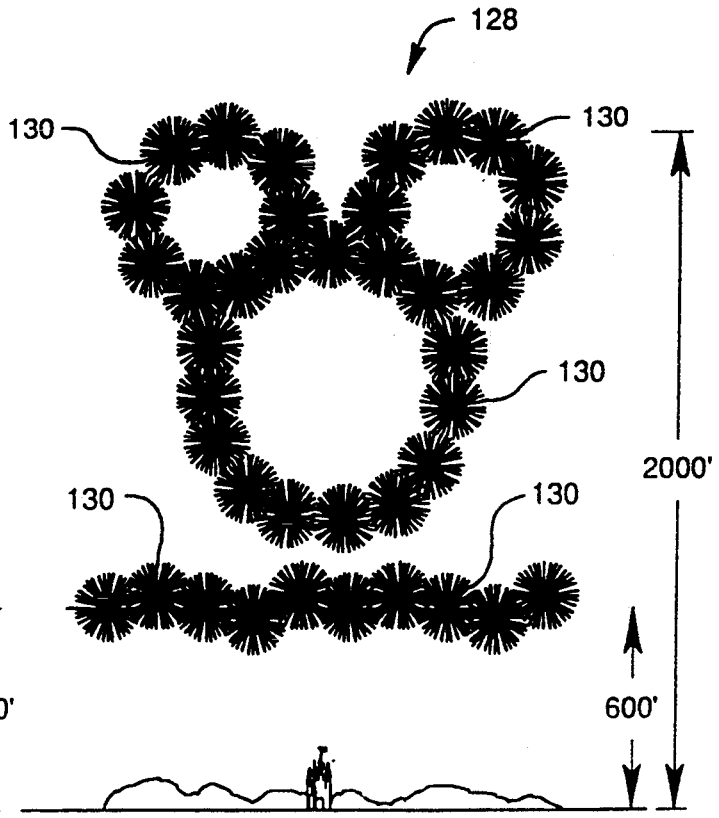
FIG. 26 is an elevational view representing a pyrotechnic display created by the method and system of the present invention.

In contrast, FIG. 26 illustrates another pyrotechnic display 128 of the type which may be achieved by the method and system of the present invention. Here, projectiles 10 designed to explode at an altitude of 600 feet will explode at an altitude between approximately 560–640 feet. This variation of 40 feet on either side represents a deviation of only about 6.7 percent. As noted above, prior art pyrotechnic displays have a deviation in the range of 16 percent or more.

The pyrotechnic display 128 of FIG. 26 also illustrates a plurality of detonated projectiles 130 synchronized by the control system 15 to detonate substantially at the same time to form a particular shape or pattern in the sky. Alternatively, as noted above, detonation of the projectiles 10 can be synchronized to music, dialogue or other sounds by the control system 15, in view of the precise timing of the projectile detonation. Also, since the projectiles 10 can be launched to high altitudes at various locations in the sky, due to the launcher's precise aiming capabilities and relatively high launch velocities, an endless pattern of pyrotechnic displays 130 can be created at a variety of locations above the ground 30.

In addition to the precision provided by the method and system of the present invention, the projectiles 10 are capable of being launched as much as three times higher, and perhaps more, than the existing prior art projectiles. For example, a nominal 6 inch prior art projectile can be launched only to about 600 feet, while a 6 inch projectile 10 of the present invention can be launched to altitudes of 2,000 feet and higher. As a general rule, the existing prior art projectiles, at the largest practical size, have a ceiling of about 1,000 feet, whereas the ceiling for the projectiles 10 of the present invention is more than three times higher.

From the foregoing, it will be appreciated that the system and method of the present invention provide an accurate, safe and reliable air-launched fireworks display system. The system advantageously eliminates initial burst propelling charges and undesirable fallout of the prior art, thereby providing a safe and environmentally compatible system. The accuracy of the electronic fuse 14, in combination with the accuracy and versatility of the launcher 12, as controlled by the control system 15, in conjunction with the precision aerodynamic shape of the projectile 10, provides a precision pyrotechnic display which can be programmed to produce distinct patterns in the sky or synchronized to follow music, dialogue or other sounds.

While a particular form of the invention has been illustrated and described, it will be apparent that various modifications can be made without departing from the spirit and scope of the invention. Therefore, it is not intended that the invention be limited, except as by the appended claims.

We claim:

1. A system for creating a fireworks display, comprising:

(a) a fireworks projectile designed to explode into a fireworks display in the air, the fireworks projectile comprising a shell containing an explosive charge, wherein the shell is constructed from a composition that includes an additive such that upon detonation of the charge the shell is exploded along with the charge into small particles that are rapidly burned and consumed;

(b) an electronic fuse connected to the explosive charge in the fireworks projectile for detonating the explosive charge and exploding the fireworks projectile into the fireworks display in the air at a predetermined time period after launch; and (c) a launcher for launching the fireworks projectile into the air, in which a non-explosive launching medium comprising a compressed gas at a controlled pressure is used to propel the fireworks projectile from the launcher into the air.

2. The system of claim 1, wherein the additive is nitrocellulose and the shell has a configuration which facilitates exploding of the shell into small particles upon ignition.

3. The system of claim 2, wherein the configuration comprises a plurality of grooves formed on the inner surface of the shell.

4. The system of claim 2, wherein the configuration comprises a plurality of ridges formed on the inner surface of the shell.

5. A system for creating a fireworks display, comprising:

(a) a fireworks projectile designed to explode into a fireworks display in the air;

(b) a launcher for launching the fireworks projectile into the air, in which a compressed gas is used to rapidly expel the fireworks projectile from the launcher into the air; and (c) an electronic fuse connected to the fireworks projectile for exploding the fireworks projectile in the air at a predetermined time period after launch, wherein the electronic fuse comprises:

energy storage means for receiving electrical energy and storing it, counting means for initiating and incrementing a count at a predetermined frequency, wherein the counting means includes a precounter sequence after launch and a main counter sequence which commences upon expiration of the precounter sequence, and count storage means for storing a predetermined value that indicates a desired time delay.

6. A system for creating a fireworks display, comprising:

(a) a fireworks projectile designed to explode into a fireworks display in the air;

(b) an electronic fuse connected to the fireworks projectile for exploding the fireworks projectile in the air at a predetermined time period after launch; and (c) a launcher for launching the fireworks projectile into the air, in which a non-explosive launching medium comprising a compressed gas is used to rapidly expel the fireworks projectile from the launcher into the air.

7. The system of claim 6, wherein the fireworks projectile comprises:

(a) an explosive charge connected to the electronic fuse, wherein the charge contains a composition adapted to explode into the fireworks display upon ignition by the fuse; and (b) a shell containing the explosive charge, wherein the shell is constructed from a composition including a binding agent and an additive, such that upon ignition the shell is exploded along with the charge into small particles that are rapidly burned and consumed and which fall to the ground as lightweight inert particles.

8. The system of claim 7, wherein the binding agent is paper or plastic material and the additive is nitrocellulose.

9. The system of claim 8, wherein the shell contains a range of between approximately 0.6 gm/cm$^3$ to approximately 1.3 gm/cm$^3$ nitrocellulose.

10. The system of claim 8, wherein the nitrocellulose is initially mixed with the binding agent and thereafter formed into the shell.

11. The system of claim 8, wherein the binding agent is formed into the shell and the nitrocellulose is subsequently applied to a surface of the shell.

12. The system of claim 7, wherein the shell has a configuration adapted to facilitate exploding of the shell into small particles upon ignition.

13. The system of claim 12, wherein the inner surface of the shell is scored with a plurality of grooves to facilitate exploding of the shell.

14. The system of claim 13, wherein the plurality of grooves are arranged to intersect each other and divide the shell into small regions.

15. The system of claim 13, wherein the grooves comprise a plurality of horizontal grooves which intersect a plurality of vertical grooves.

16. The system of claim 13, wherein the grooves extend into the inner surface of the shell by a distance equal to approximately one-half of the thickness of the shell.

17. The system of claim 12, wherein the inner surface of the shell is scored with a plurality of ridges to facilitate exploding of the shell.

18. The system of claim 17, wherein the plurality of ridges are arranged to intersect each other and divide the shell into small regions.

19. The system of claim 17, wherein the ridges comprise a plurality of horizontal ridges which intersect a plurality of vertical ridges.

20. The system of claim 17, wherein the ridges extend radially from the inner surface of the shell by a distance equal to approximately one-half of the thickness of the shell.

21. The system of claim 6, wherein the launcher comprises:

(a) a pressure vessel containing the compressed gas;

(b) a launching tube having a lower end connected to the pressure vessel and an open end for expelling the fireworks projectile;

(c) a valve connected between the pressure vessel and the launching tube; and (d) a control apparatus for opening and closing the valve to accurately control the introduction of pressure from the pressure vessel to the launching tube to expel the fireworks projectile from the open end of the launching tube.

22. The system of claim 21, wherein the compressed gas is introduced into the launching tube at pressures between approximately 20 to 150 psi.

23. The system of claim 21, further comprising a breech between the pressure vessel and the launching tube for loading the fireworks projectile in the launcher.

24. The system of claim 23, wherein the breech comprises:

(a) an opening in the lower end of the launching tube through which the fireworks projectile is loaded;

(b) a stop mechanism for maintaining the fireworks projectile at a fixed position within the launching tube; and (c) a cover on the launching tube adapted to move between an open position to permit loading of the fireworks projectile and a closed position to permit launching of the fireworks projectile after loading.

25. The system of claim 24, wherein the cover on the breech comprises a sleeve surrounding the launching tube, the sleeve being axially slidable with respect to the launching tube between the open position, in which the sleeve is axially spaced from the opening, and the closed position, in which the sleeve covers the opening.

26. The system of claim 24, wherein the cover on the breech comprises a door pivotally connected to the breech such that, in the open position, the door pivots outwardly away from the opening and, in the closed position, the door pivots inwardly to cover the opening.

27. The system of claim 23, wherein the launching tube is pivotally connected to the breech, and wherein the breech comprises an enclosure having a cylinder for receiving the fireworks projectile, such that the launching tube can be moved into and out of registration with the cylinder for launching and loading of the fireworks projectile, respectively.

28. The system of claim 23, wherein the breech comprises a plurality of fireworks projectile holding tubes that are indexed into and out of registration with the launching tube to permit successive launching of a plurality of fireworks projectiles.

29. The system of claim 28, wherein the plurality of fireworks projectile holding tubes are arranged in a straight row.

30. The system of claim 28, wherein the plurality of fireworks projectile holding tubes are arranged in a circular or cylindrical manner.

31. The system of claim 6, further comprising an aiming apparatus for adjusting the position of the launcher and aiming of the fireworks projectile.

32. The system of claim 31, wherein the aiming apparatus comprises a plurality of legs which support the launcher and which are adjustable to change the angle of the launcher with respect to the ground.

33. The system of claim 6, wherein the electronic fuse comprises:

energy storage means for receiving electrical energy and storing it;

counting means for initiating and incrementing a count at a predetermined frequency; and count storage means for storing a predetermined value that indicates a desired time delay.

34. The system of claim 33, wherein the energy storage means comprises a plurality of storage capacitors.

35. The system of claim 33, wherein the counting means includes a local oscillator that generates a series of pulses.

36. The system of claim 35, wherein the count storage means comprises a binary counter that receives the pulses from the local oscillator and increments its count with each pulse.

37. The system of claim 33, wherein the counting means includes a precounter sequence after launch and a main counter sequence which commences upon expiration of the precounter sequence.

38. The system of claim 37, wherein the main counter sequence will cause detonation of the fireworks projectile when the main counter sequence elapses, and wherein the main counter sequence will not be initiated until an actual launch has occurred, as determined by the precounter sequence which elapses only after an actual launch has occurred.

39. A system for creating a fireworks display, comprising:

(a) a fireworks projectile designed to explode into a fireworks display in the air;

(b) an electronic fuse connected to the fireworks projectile for exploding the fireworks projectile in the air at a predetermined time period after launch; and (c) a launcher for launching the fireworks projectile into the air, wherein the launcher comprises:

a pressure vessel containing a compressed gas, a launching tube having a lower end connected to the pressure vessel and an open end for expelling the fireworks projectile, a valve connected between the pressure vessel and the launching tube, and a control apparatus for opening and closing the valve to accurately control the introduction of pressure from the pressure vessel to the launching tube to expel the fireworks projectile from the open end of the launching tube.

40. The system of claim 39, wherein the control apparatus comprises a central controller that produces control signals for initiating a launch sequence, and a local control unit that receives the control signals from the central controller, produces a predetermined ignition delay time, and controls the opening and closing of the valve, and wherein the electronic fuse receives the ignition delay time from the local control unit and ignites the fireworks projectile after the delay time has elapsed following launch of the fireworks projectile.

41. A system for creating a fireworks display, comprising:

(a) a fireworks projectile that is designed to explode into a fireworks display in the air, the fireworks projectile comprising a shell containing an explosive charge, wherein the shell is constructed from a composition that includes an additive such that upon detonation of the charge the shell is exploded along with the charge into small particles that are rapidly burned and consumed;

(b) an electronic fuse connected to the explosive charge in the fireworks projectile for detonating the explosive charge and exploding the fireworks projectile into the fireworks display in the air at a predetermined time period after launch; and (c) a launcher for launching the fireworks projectile into the air, wherein the launcher comprises:

a pressure vessel containing a compressed gas, a launching tube having a lower end connected to the pressure vessel and an open end for expelling the fireworks projectile, a valve connected between the pressure vessel and the launching tube, and a control apparatus for opening and closing the valve to accurately control the introduction of pressure from the pressure vessel to the launching tube to expel the fireworks projectile from the open end of the launching tube.

42. The system of claim 6, further comprising an electronic controller for communicating with and programming the launcher to launch the fireworks projectile and for communicating with and programming the electronic fuse to explode the fireworks projectile in the air at a predetermined time after launch.

43. The system of claim 42, wherein the electronic controller comprises a central controller that produces control signals for initiating a launch sequence, and a local control unit that receives the control signals from the central controller, produces a predetermined ignition delay time, and controls the launcher, wherein the electronic fuse receives the ignition delay time from the local control unit and ignites the fireworks projectile after the delay time has elapsed following launch of the fireworks projectile.

44. The system of claim 6, wherein there are a plurality of fireworks projectiles with electronic fuses and a plurality of launchers controlled by an electronic controller for communicating with and programming each of the launchers to launch each of the fireworks projectiles at a predetermined time to a predetermined altitude and location in the air, and for communicating with and programming the electronic fuse of each of the fireworks projectiles to explode the fireworks projectile in the air at a predetermined time after launch.

45. The system of claim 44, wherein the electronic controller programs each of the launchers and each of the electronic fuses such that the fireworks projectiles explode in the air in relatively precise synchronization with music, dialogue or other sounds.

46. A system for creating a fireworks display, comprising:

(a) a fireworks projectile designed to explode into a fireworks display in the air;

(b) a fuse connected to the fireworks projectile for exploding the fireworks projectile in the air at a predetermined time period after launch; and (c) a launcher for launching the fireworks projectile into the air, wherein the launcher comprises:

a pressure vessel containing a compressed gas, a launching tube for holding the fireworks projectile prior to launch, wherein the launching tube has one end connected to the pressure vessel and an open end for expelling the fireworks projectile, and a control apparatus for controlling the introduction of compressed gas from the pressure vessel to the launching tube to expel the fireworks projectile from the open end of the launching tube.

* * * * *